US005407364A

United States Patent [19]

Tzeng et al.

[11] Patent Number: 5,407,364

[45] Date of Patent: Apr. 18, 1995

[54] RETENTION AND COUPLING ASSEMBLY OF CONNECTOR

[75] Inventors: Tian-Jy Tzeng; Michelle Lin; Kun-Tsan Wu, all of Taipei Hsien, Taiwan, Prov. of China

[73] Assignee: Genrife Company Limited, Hong Kong, Hong Kong

[21] Appl. No.: 165,730

[22] Filed: Dec. 10, 1993

[51] Int. Cl.[6] ..... H01R 13/73

[52] U.S. Cl. ..... 439/567

[58] Field of Search ..... 439/554, 557, 567, 571, 439/607; 248/500

[56] References Cited

U.S. PATENT DOCUMENTS 4,911,659 3/1990 Viselli ..... 439/564

5,125,853 6/1992 Hashiguchi ..... 439/607

*Primary Examiner*—Gary F. Paumen

[57] ABSTRACT

An assembly of coupling and retention means (10) of a connector (8) for fastening to another complementary connector which is mating with the subject connector (8), and for mounting onto the board on which the connector is seated, includes a coupling device (12) having an internally threaded insert (16) and an integral base (14), and further includes a retention device (20) stamped and formed by a metal blank. The retention device (20) includes at the top a box portion (22) having a space to retainably receive the base (14) of the coupling device (12) therein, and a pair of mounting legs (40) extending downward at the bottom for mounting onto the board. The connector (8) has a cavity (92) at the bottom for reception of the box portion (22) of the retention device (20) therein wherein the coupling device (12) and the retention device (20) are axially aligned with each other and extending in the same direction as that of the contacts (81) of the connector (8).

10 Claims, 4 Drawing Sheets

RETENTION AND COUPLING ASSEMBLY OF CONNECTOR

BACKGROUND OF THE INVENTION

1. Field of The Invention

The invention relates to the retention feature and the coupling feature of an electrical connector which is adapted to mate a complementary connector, especially to a combination of the retention and coupling features.

2. The Prior Art

The typical Input/output (I/O) port connector generally includes a retention device such as a boardlock positioned proximate the bottom surface of the connector and adapted to be mounted on a board against which such bottom surface abuts, and a coupling device such as a threaded insert positioned proximate the mating surface of the connector and adapted to be connected, through a screw, to a complementary connector or a backpanel of the computer against which such mating surface abuts. Most I/O connectors are of right angle type of which the retention device (and/or mounting surface) and the coupling device (and/or mating surface) are perpendicular to each other, for example, U.S. Pat. Nos. 4,435,031, 4,512,618, 4,679,883, 4,709,973, 4,717,219, 4,721,473, 4,795 353, 4,842,552, 4,865,555, 4,911,659 4,938,704, 4,943,244, 5,004,430, 5,024,607, 5,066,237, 5,083,926, 5,085,589, 5,104,326, 5,108,312 and 5,249,974. It is noted that some of the aforementioned patents disclose the separate L-shaped bracket or the plate portion integral with the shield of the connector or with the retention device to electrically connect the retention device and the coupling device for grounding and/or structural reinforcement consideration. Other I/O connectors are deemed as the vertical type of which the mating surface and the mounting surface are parallel to each other, and thus the retention device and the coupling device are generally axially aligned, for example, U.S. Pat. Nos. 4,824,398, 4,874,336 and 4,895,535.

The object of the invention of this application is to solve some disadvantages mainly experienced in the vertical type connector such as U.S. Pat. No. 4,824,398. As shown in FIG. 1, the conventional vertical type connector 2 includes the insulative housing 200 composed of the top half 202 and the bottom half 204, and a shield 206 positioned at the top. The housing 200 has a plurality of passageways 208 extending therethrough for reception of a corresponding number of contacts 210 therein. The housing 200 and the shield 206 have apertures 212 at two opposite ends for receiving the two corresponding integral threaded inserts and boardlocks 214, respectively. It can be understood that, in the right angle type connector, the retention device and the coupling device are respectively located on the horizontal mounting surface and the vertical mating surface so that a relatively sufficient space is available thereabout to easily configure the positions and the structures of such retention device and the coupling device, respectively. Differently, in the vertical type connector the mounting surface and the mating surface are closely parallel to each other, so that the retention device and the coupling device are configured axially aligned with each other due to the limited space available therebetween. Thus, this structural requirement generally results in the retention device and the coupling device being made of one piece and integral with each other, as shown in FIG. 1 of this application or in U.S. Pat. No. 4,824,398.

Because the coupling device generally is provided with the internal threads to corporate the screw for fastening, it is required for such coupling device to be stiff. Hence, the coupling device and its associated integral retention device are generally made of stiff material and lathed to be their final shapes. It can be appreciated that such lathing process, including cutting the slot 216 and turning internal holes 215 and 217, takes time. On the other hand, the retention device, i.e., the boardlock, is expected to be elastic enough for easy insertion into the hole of the board on which the connector is mounted, and for efficiently retaining the connector thereon. Additionally, using a stiff boardlock also prohibits a relatively larger tolerance applied to the combination of the hole of the board and the boardlock. Therefore, the high precision of the dimensions of the board or the boardlock is required that will complicate the manufacturing and cost money.

Another disadvantage is that the threaded insert portion 218 has an internal hole 215 for receiving the corresponding screw (not shown), the boardlock portion 220 also has an internal hole 217 for allowing the leg 222 of the boardlock portion 220 to move inwardly during mounting onto the board (not shown), and these two internal holes 215 and 217 are not expected to be communicate with each other. The reason is that the solder may inappropriately contaminate or stuff the hole 215 of the insert portion 218 through the communicating hole 217 of the boardlock portion 220 during the wave soldering process which fastens the boardlock portion 220 to the board. Under this situation, the screw can not thread into the insert portion 218 for securement thereto. Therefore, the internal hole 215 of the insert portion 218 and the internal hole 217 of the boardlock portion 220 are segregated with each other by the solid intermediate plate 224. This segregation will make it difficult to lathe the internal threads of insert portion 218, and result in less threads therein which is unfavorable to securely fasten a screw therein.

Accordingly, the object of the invention is to provide an assembly not only including the threaded insert portion and the boardlock portion fastened to each other in a compact size for compliance with the structural requirement of the vertical type connector, but also satisfying the expectation of the elasticity of the boardlock leg and of the sufficient threads of the insert portion to hold the screw therein, and simplifying the manufacturing thereof.

SUMMARY OF THE INVENTION

According to an aspect of the invention, an assembly of coupling and retention means of a connector for fastening to another complementary connector which is mating with the subject connector, and mounting onto the board on which the connector is seated, includes a coupling device having an internal threaded insert and an integral base, and further includes a retention device stamped and formed by a metal blank. The retention device includes at the top a box portion having a space to retainably receive the base of the coupling device therein, and a pair of mounting legs extending downward at the bottom for mounting onto the board. The connector has a cavity at the bottom for reception therein of the box portion of the retention device wherein the coupling device and the retention device are axially aligned with each other and extending in the same direction as that of the contacts of the connector.

DETAILED DESCRIPTION OF THE PREFERRED EMBODIMENTS

References will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
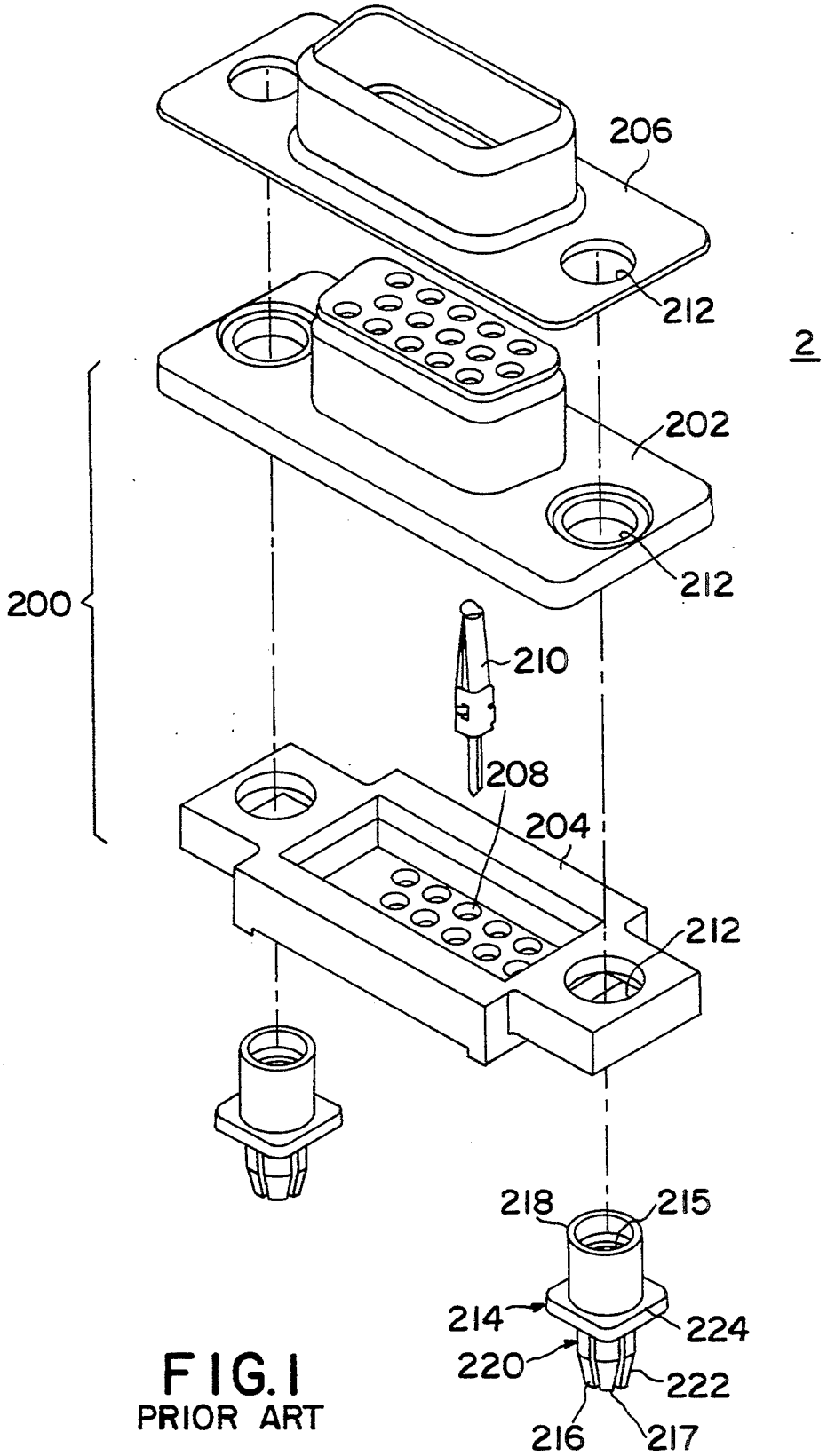
FIG. 1 PRIOR ART
FIG. 1 is an exploded perspective view of a prior art vertical I/O connector.
Figure 2:
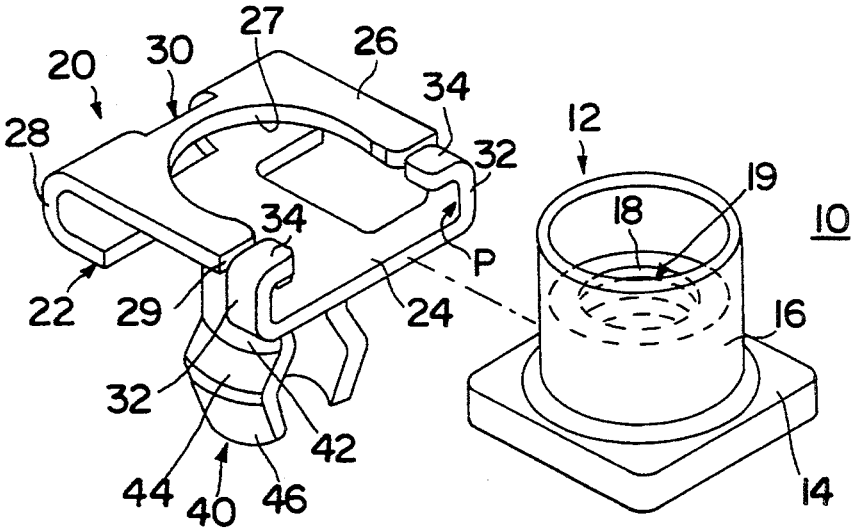
FIG. 2 is an exploded perspective view of an assembly of coupling and retention means of a presently preferred embodiment for use with a vertical I/O connector in accordance with the present invention.
Figure 3:
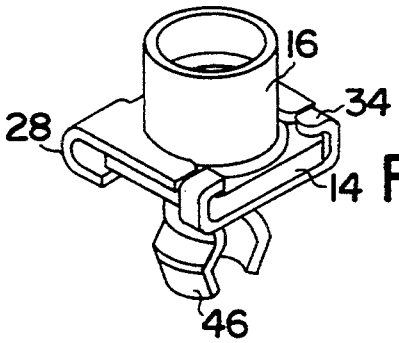
FIG. 3 is a perspective view of an assembled assembly of coupling and retention means of FIG. 2.

It will be noted here that for a better understanding, like components are designated by like reference numerals throughout the various figures. Attention is now directed to FIG. 2 where an assembly 10 of coupling and retention means includes a coupling device 12 and a retention device 20.

Figure 8:
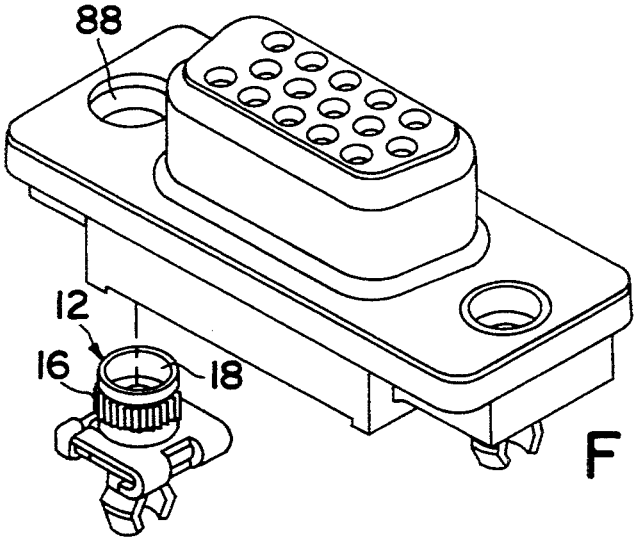
FIG. 8 is a perspective view of the assembled connector having the assembly of coupling and retention means removed therefrom of a third embodiment in accordance with the present invention.

The coupling device 12 includes a generally square base 14 and a tubular insert 16 extending therefrom. An hole 18 axially extends through the insert 16 and the base 14 and has internal through-threads 19 thereof for engagement with a screw (not shown) inserted therein. The thickness of tubular wall around of the top portion of the insert 16 is reduced for easy deformation such that a riveting process may be applied thereto when such insert 16 is fastened to the connect housing 80 as shown in FIG. 8.

The retention device 20 which is stamped and formed by a metal blank, includes at the top a holding or box portion 22 having a platform 24, a parallel clipping plate 26 and a bight 28 intermediating therebetween. The clipping plate 26 includes a generally round opening 27 extending from the center to the front edge 29 of the clipping plate 26 so that the insert 16 of the coupling device 12 can be inserted into the opening 27 of the clipping plate 26 from the front edge 29 thereof.

Figure 6:
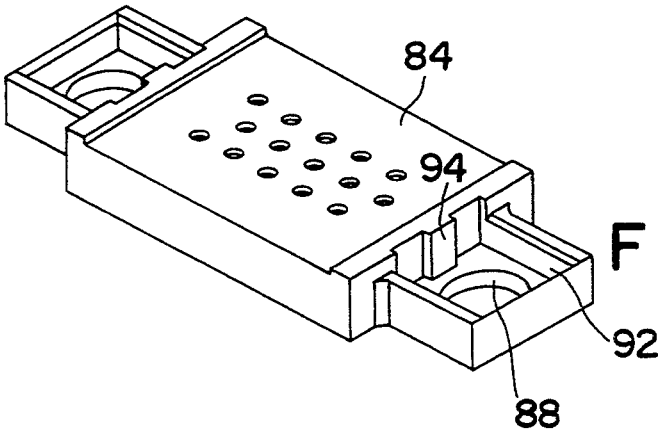
FIG. 6 is a bottom view of the housing of the connector of FIG. 5 to show the cavity therein.

A recess 30 is formed in the bight 28 for engagement with a engagement bar 94 of the connector 80 as shown in FIG. 6 that will be illustrated in detail later. A pair of reinforcement arms 32 extend upwardly from the front portion of the platform 24 and positioned in front of the front edge 29 of the clipping plate 26. The top portions 34 of the arms 32 are bent inward to each other in parallel to the platform 24 and generally in coplanarity with the clipping plate 26. The space between these two top portions 34 of the arms 32 is generally identical to the lateral dimension of the opening 27 about the front edge 29 of the clipping plate 26. It can be seen that the platform 24 incorporating two opposite reinforcement arms 32, forms a rectangle vertical opening P facing the outside through which the base 14 of the coupling device 10 can be laterally inserted into the box portion 22.

A mounting portion including a pair of mounting legs 40 respectively integrally extend downward from two opposite sides of the platform 24, and each mounting leg 40 includes a vertical section 42 at the top and a diverging section 44 and converging section 46 at the bottom to engage an aperture of the board on which the connector is mounted for retention of the connector thereon.

When assembled, the base 14 of the coupling device 12 can be horizontally inserted into the internal space of the box portion 22, which is defined by the platform 24, the clipping plate 26 and the bight 28, from the front opening P of the box portion 22. At the same time, the insert 12 also can pass the space between the two opposite arms 32 and enter the opening 27 in the clipping plate 26. Eventually, the insert 16 of the coupling device 12 is substantially aligned with the mounting portion in position. Because the distance between the parallel platform 24 and the clipping plate 26 of the retention device 20 is substantially equal to the thickness of the base 14 of the coupling device 12, the base 14 of the coupling device 12 can be appropriately sandwiched between the platform 24 and the clipping plate 26 of the retention device 20 without vertical movement. Also, the distance defined between two opposite arms 32 and in the opening 27 around the front edge 29 of the clipping plate 26 is somewhat smaller than the diameter of the insert 16 of the coupling device 12, so that the insert 16 can be retained within the opening 27 without horizontal movement.

It can be understood that through the reinforcement arms 32, the opening P is reliably formed thereof for easily precisely inserting the base 14 of the coupling device 12 into the box portion 22 of the retention device 20. It is also appreciated that the opposite arms 32 and the front portions of the clipping plate 26 can be resiliently deflected outwardly for allowance of passage of the insert 16 of the coupling device 12 into the box portion 22 of the retention device 20.

Figure 4:
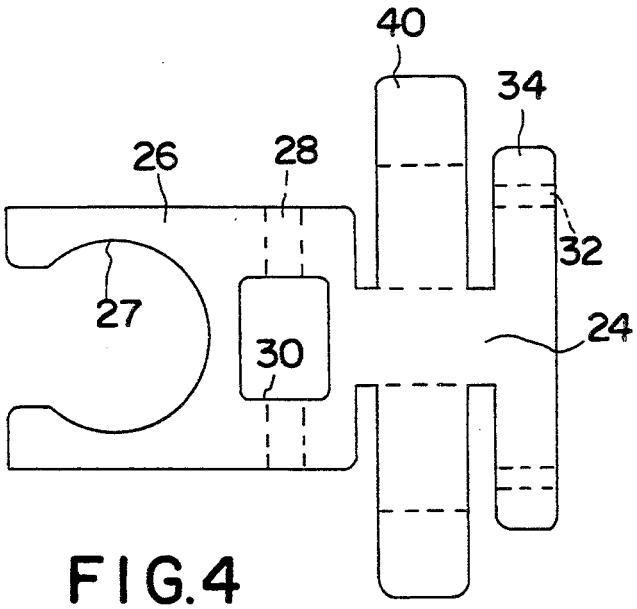
FIG. 4 is a top view of an extended retention device of the FIG. 2 which is stamped from a blank but has not been formed to be its final shape.

FIG. 4 shows a planar extended manner of the retention device 20 which has been stamped from a metal blank but not formed to its final shape. It is noted that the final configuration of the retention device 20 can be obtained by successively bending such planar item along the dashed lines.

Figure 5:
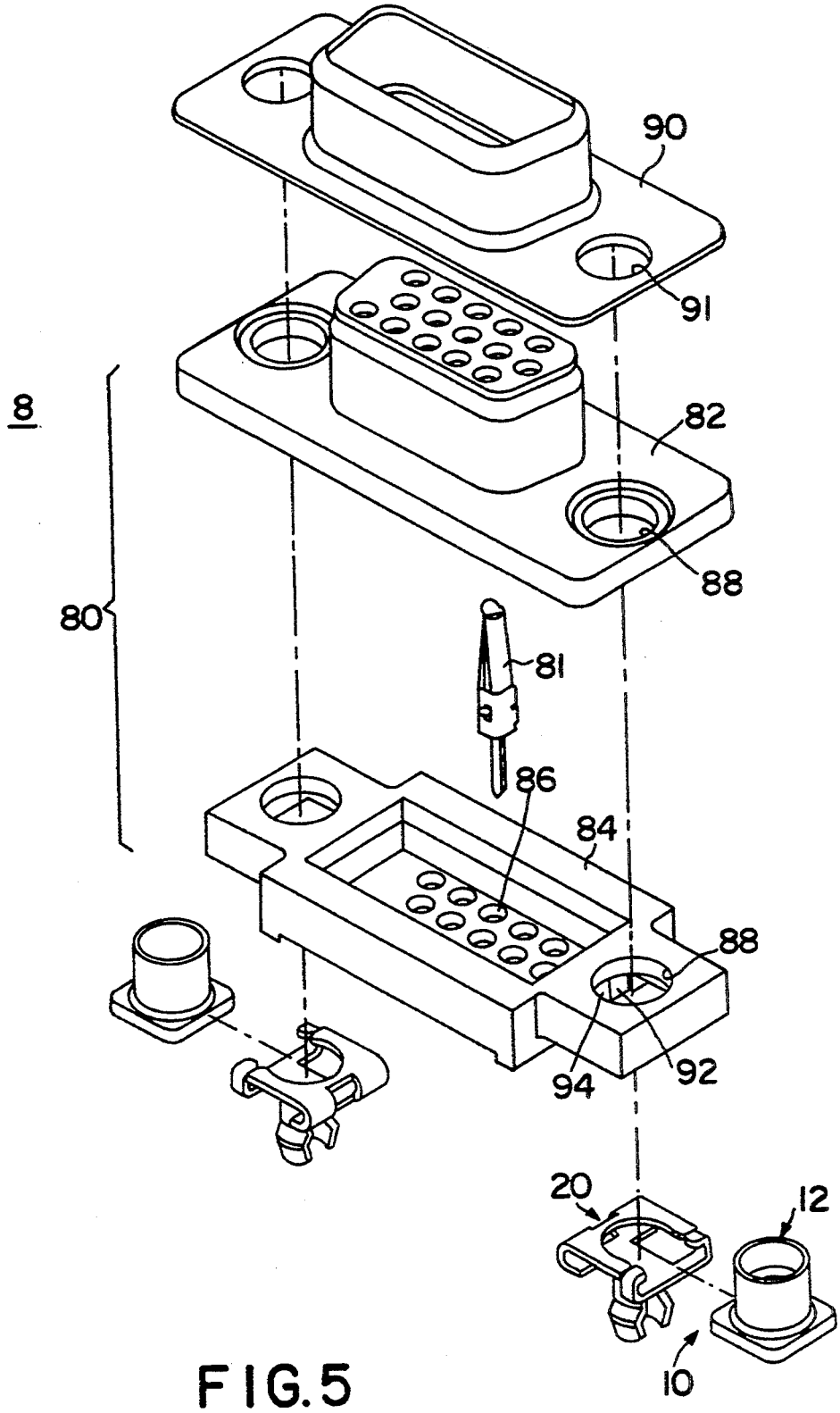
FIG. 5 is an exploded perspective view of a vertical I/O connector and the corresponding assembly of coupling and retention means of FIG. 2 in accordance with the present invention.

With reference to FIG. 5, the connector 8 includes a housing 80 composed of the top half 82 and the bottom half 84 vertically stacked together. A plurality of passageways 86 extend through the housing 80 vertically for receiving the corresponding contacts 81 therein. Each half 82, 84 has a pair of apertures 88 are positioned at two opposite ends thereof. A shield 90 positioned on the top of the housing 80, also has a pair of apertures 91 at two opposite ends in alignment with the corresponding apertures 88 in the housing 80.

Referring to FIG. 6, a generally square cavity 92 is formed at two opposite ends of the underside of the bottom half 84 and an engagement bar 94 is positioned within the cavity 92 for engagement with the recess 30 in the bight 28 of the retention device 20. When assembled, the assembly of coupling and retention means 10 is disposed into the cavity 92 of the housing 80 of the connector 8 from the bottom. The insert 16 of the coupling device 10 successively extends through the apertures 88 of the housing 80 and the aperture 91 of the shield 90. Then, the top portion of the insert 16 is deformed downward to form a flange and riveted to abut against the periphery of the aperture 91 of the shield 90 so that the shield 90 and the housing 80 can be securely sandwiched between the riveted top flange of the insert 16 of the coupling device 12 and the box portion 22 of the retention device 20. Hence, the assembly of coupling and retention means 10 can not be moved with regard to the housing 80 in the vertical direction. Additionally, the engagement between the engagement bar 94 with the recess 30 in the box portion 22 of the retention device 20 and the configuration of the cavity 92 both prohibit the assembly of coupling and retention means 10 from horizontal movement or rotation. Therefore, the assembly of coupling and retention means 10 is fastened to the connector housing 80 in position for being ready to mount on the board and/or connect to a complementary connector through a screw (not shown) inserted into the corresponding apertures 88, 91.

It can be understood that in comparison with the prior art, the retention device 20 is made of a metal sheet so that it is easy to be manufactured and has a better resilience of its mounting legs 40 for easy mounting on the board. In addition, the threads 19 extend through the insert 16 so that lathing is easier applied thereto and more threads are formed in the hole 18 of the insert 16 for better securement to the inserted screw. It can be understood that the reason why the threads 19 can extend through the whole coupling device 12 is that the platform 24 can cover the bottom opening of the hole 18 of the insert 16, so no solder may invade into the hole 18 of the insert 16 during wave soldering process which fastens the connector 8 onto the board. Furthermore, the coupling device 12 and the retention device 20 can be pre-assembled as a unit for being ready to fasten to the connector housing 20. Accordingly, the invention has the advantage of the prior art vertical I/O connector, i.e., a compact sized one-piece set (including coupling and retention means), but has no aforementioned disadvantages of the prior art vertical I/O connector.

Figure 7:
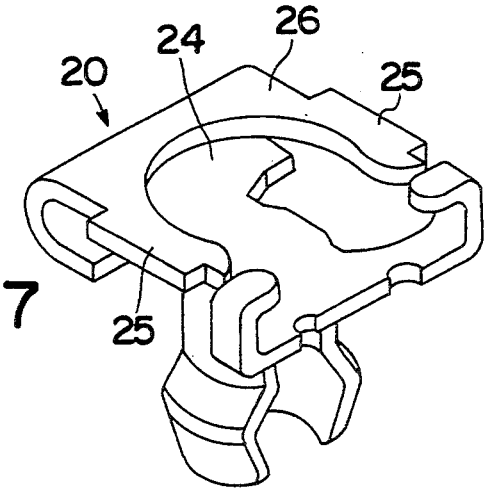
FIG. 7 is a perspective view of the retention device of another embodiment in accordance with the present invention.

FIG. 7 shows another embodiment of the invention wherein there are two protrusions 25 at two sides of the clipping plate 26 to replace recess 30 thereof for engagement with the corresponding additional slots (not shown) in the housing for laterally loading the assembly 10 onto the housing 80.

FIG. 8 shows a third embodiment of the invention wherein the outer surface of the insert 16 is knurled to increase friction between the insert 16 and the apertures 88 of the housing 80 for securement.

While the present invention has been described with reference to a few specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An assembly of coupling and retention means for use with a connector comprising:

a coupling device including a base and an insert extending integrally from the base, said insert having internal threads to receive a screw therein for securement to a complementary connector; and a retention device including a holding portion and a mounting portion extending integrally from the holding portion, said mounting portion adapted to engage a hole of a board on which the connector is mounted for fastening the connector onto said board;

said holding portion of the retention device adapted to retain the base of the coupling device thereto so that said coupling device and said retention device can be properly pre-assembled as one unit before they are ready to be attached to a housing of said connector, wherein said holding portion has a box configuration including a platform, a parallel clipping plate and a bight intermediating therebetween so that the base of the coupling device can be received within a space defined among the platform, the clipping plate and the bight.

2. The assembly of coupling and retention means as described in claim 1, wherein said coupling device and said retention device are axially aligned with each other.

3. The assembly of coupling and retention means as described in claim 1, wherein said mounting portion includes at least a pair of mounting legs integrally extending from two opposite sides of the platform downward.

4. The assembly of coupling and retention means as described in claim 1, wherein a recess is formed in the bight for engagement with an engagement bar of the housing of said connector.

5. A connector comprising:

an insulative housing having a plurality of passageways extending through for reception of a corresponding number of contacts therein; and at least one aperture located in the housing to receive an assembly of coupling and retention means therein;

said coupling and retention means includes a coupling device and a retention device which are manufactured separately but adapted to be pre-assembled as one unit for attachment to said connector, wherein said coupling device includes a base and an insert having internal threads extending through, and said retention device includes a box portion and a mounting portion whereby said box portion of the retention device can receive the base of the coupling device therein so that the coupling device and the retention device are axially aligned with each other.

6. The connector as described in claim 5, wherein said connector is a vertical I/O connector and said assembly of coupling and retention means is parallel to the contacts in the housing.

7. The connector as described in claim 5, wherein said housing has a cavity on the underside for receiving said box portion of the retention device.

8. The connector as described in claim 5, wherein said base of the coupling device is inserted into the box portion of the retention device from a lateral direction, and said assembly of coupling and retention means is loaded onto the housing of the connector from the bottom.

9. The connector as described in claim 5, wherein said assembly of coupling and retention means is fastened to the housing of the connector by riveting a top portion of said insert of the coupling device.

10. A retention device stamped from a metal blank for use with a coupling device in a connector, comprising:

a box portion including a platform, a parallel clipping plate and a bight intermediating therebetween;

a mounting portion integrally extending downward from the platform for engagement within a hole of a board on which the connector is seated;

a space defined among the platform, the clipping plate and the bight, said space being adapted to retainably receive a base of the coupling device therein; and a vertical opening, facing to the exterior, through which the base of the coupling device can be laterally inserted into the space in the box portion of the retention device.

* * * * *